US005249675A

United States Patent [19]

Strauss et al.

[11] Patent Number: 5,249,675

[45] Date of Patent: Oct. 5, 1993

[54] PACKAGING FOR EYEWEAR

[76] Inventors: Kurt Strauss; Helmut Strauss, both of 213 S. Van Brunt St., Englewood, N.J. 07631

[21] Appl. No.: 985,341

[22] Filed: Nov. 30, 1992

Related U.S. Application Data

[63] Continuation of Ser. No. 839,961, Feb. 21, 1992, abandoned.

[51] Int. Cl.[5] ..... A45C 11/04

[52] U.S. Cl. ..... 206/216; 206/5; 206/305; 206/316.1

[58] Field of Search ..... 206/5, 5.1, 6, 216, 206/305, 316.1, 316.3

[56] References Cited

U.S. PATENT DOCUMENTS

| | | | |
|---|---|---|---|
| 3,000,417 | 9/1961 | Goldstein | 206/5 |
| 3,007,566 | 11/1961 | Morris | 206/5 |
| 3,144,127 | 8/1964 | Fogel | 206/5 |
| 3,857,482 | 12/1974 | Shelton | 206/5 X |
| 4,744,461 | 5/1988 | Lapham | 206/5 |
| 4,865,186 | 9/1989 | Gates | 206/5 |

FOREIGN PATENT DOCUMENTS

| | | |
|---|---|---|
| 451424 | 9/1948 | Canada . |
| 20934 | of 1901 | United Kingdom . |
| 16414 | of 1908 | United Kingdom . |

*Primary Examiner*—Steven N. Meyers
*Assistant Examiner*—Jacob K. Ackun, Jr.
*Attorney, Agent, or Firm*—Edwin D. Schindler

[57] ABSTRACT

Packaging for an eyewear article having a pair of lenses with diopter power is disclosed, which preferably includes an enclosure portion for substantially enclosing the eyewear article for eventual sale and a tag portion affixed to the enclosure portion. A lens is preferably included with the tag portion, which is in addition to the pair of lenses of the eyewear article, which is accessible to a prospective consumer without requiring the prospective consumer to open the enclosure portion of the packaging for retrieval of the eyewear article contained therein. The lens provided with the tag portion, being in addition to the lenses of the eyewear, has an optic power which is substantially equal to the diopter power of the pair of lenses of the eyewear article so that the prospective consumer may readily judge the diopter power of the eyewear article.

5 Claims, 2 Drawing Sheets

PACKAGING FOR EYEWEAR

This application is a continuation of application Ser. No. 07/839,961, filed Feb. 21, 1992, now abandoned.

BACKGROUND OF THE INVENTION

1. Technical Field of the Invention

The present invention relates, generally, to an improved packaging article for eyewear.

More particularly, the present invention relates to an improved packaging for eyewear which provides a lens contained substantially flush within a tag portion of said packaging. The lens within the tag portion has an optic power which matches that of the eyewear contained within the packaging.

The packaging of the present invention allows a consumer, prior to purchase, to determine the optic power of the lenses of the eyewear within the packaging without having to physically open and damage the packaging.

2. Description of the Prior Art

Prior to the present invention, manufacturers and retailers of packaged eyewear, such as reading glasses, sun glasses, etc., were required to accept the reality that, in the retail process, a certain proportion of packaging would have to be opened by prospective consumers who, only after having broken open the packaging, decided against purchase of the eyewear article due to the unacceptable diopter power of the lenses for that particular consumer. In such instances, before the eyewear could again be offered for sale, it had to be re-packaged. During the intervening period, it was unable for sale.

As explained herein, the present invention allows a prospective consumer to gauge the optic power of the lenses of the packaged eyewear without damaging the packaging and, thereby, not requiring the re-packaging of any such eyewear not originally purchased.

SUMMARY OF THE INVENTION

It is, therefore, an object of the present invention to provide an improved packaging for eyewear which affords a prospective consumer the opportunity to judge the optic power of the lenses of the eyewear being offered for sale, without the need for the consumer to open the packaging for the purpose of testing such optic power.

It is a further object of the present invention to provide manufacturers and retailers of packaged eyewear with a means for reducing, if not eliminating, the need to re-package eyewear in situations where the packaging is opened for testing the optic power of the eyewear, but the article is not purchased due to the unacceptability of this feature.

It is a further object of the present invention to overcome the disadvantages inherent in the prior art means for packaging eyewear for retail sale.

The foregoing and related objects are achieved by present invention which provides an improved packaging for eyewear which comprising a lens contained substantially flush within a tag portion of said packaging. The lens within the tag portion has an optic power which matches that of the eyewear contained within the packaging.

The eyewear article, itself, would remain enclosed within the undamaged packaging. Preferably, the enclosed packaging containing the eyewear article would be comprised, at least in part, by a clear plastic so as to allow the prospective consumer to view and judge the acceptability of the frame and lens design construction for aesthetic purposes.

The packaging may further contain information concerning the strength of the eyewear, etc., in the form of printed matter.

The packaging of the present invention allows a consumer, prior to purchase, to determine the optic power of the lenses of the eyewear within the packaging without having to physically open and damage the packaging.

Other objects and features of the present invention will now be described in greater detail with reference being made to the accompanying drawing figures. It should, of course, be recognized that the drawing figures are intended to illustrate certain preferred embodiments of the present invention and are not intended as a means for defining the scope and limits of the present invention.

BRIEF DESCRIPTION OF THE DRAWING FIGURES

In the drawing, wherein similar reference numerals denote similar features throughout the several views.

Figure 3:
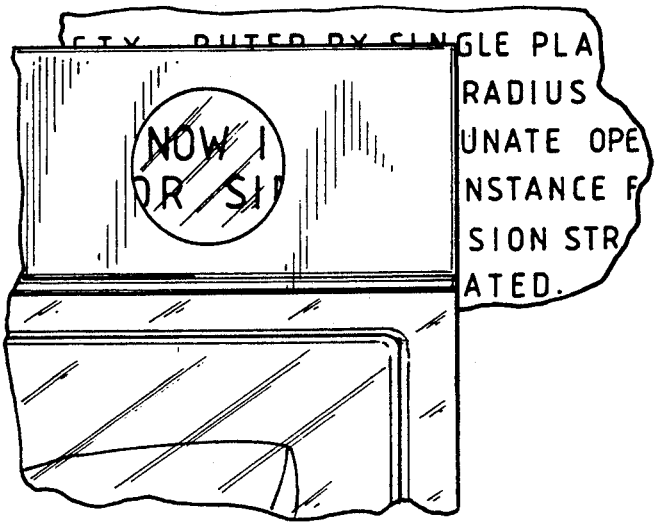
Figure 4:
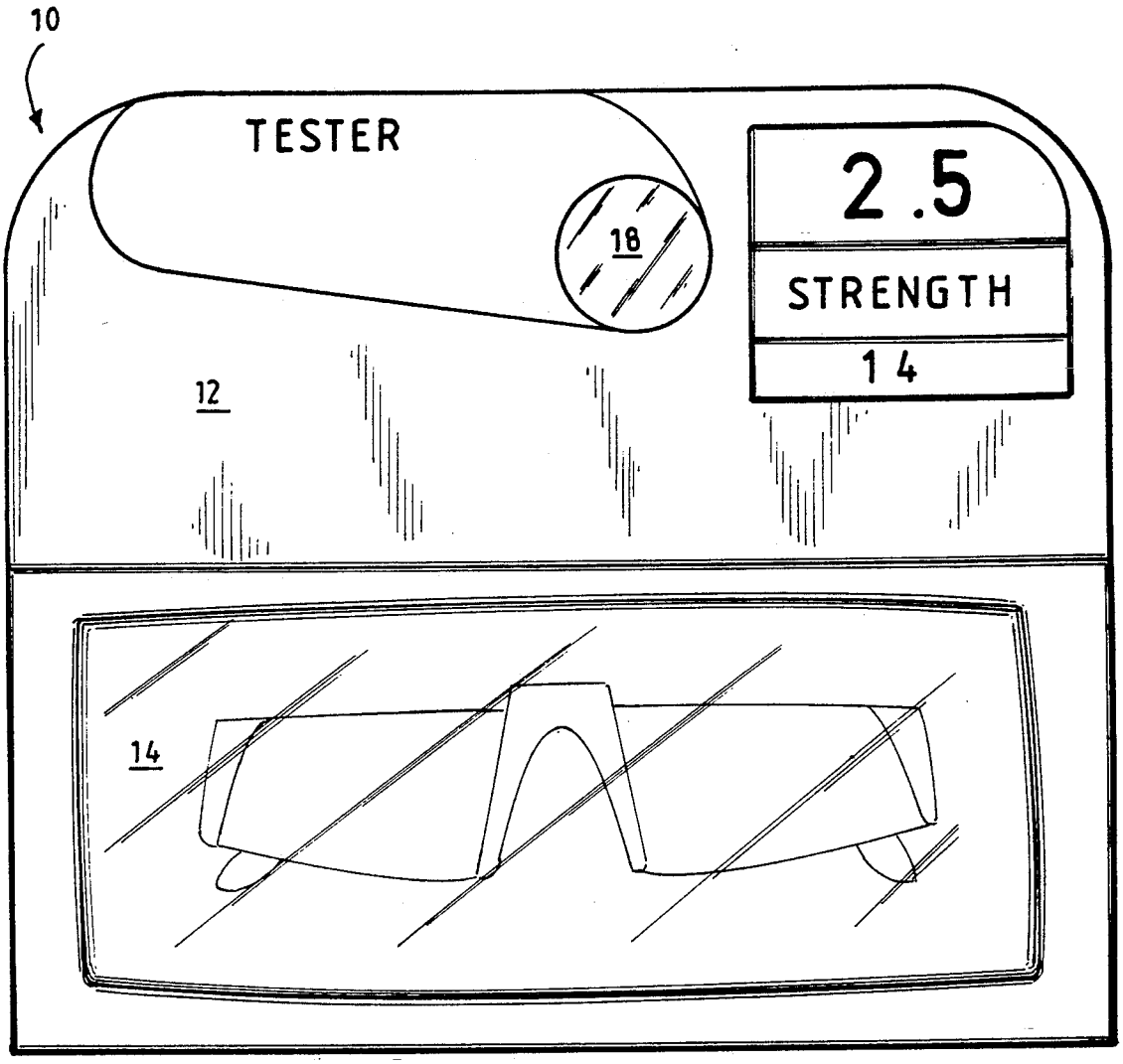

FIG. 3 is a partial, elevational view of the eyewear packaging of the present invention showing the lens portion of the packaging being substantially flush with the tag portion and, further, illustrating the optic power of said lens; and, FIG. 4 is an elevational view of a preferred embodiment of the eyewear packaging of the present invention, illustrated without a pair of eyewear contained within the lower portion of the packaging designed for such purpose.

DETAILED DESCRIPTION OF THE DRAWING FIGURES AND PREFERRED EMBODIMENTS OF THE INVENTION

Figure 1:
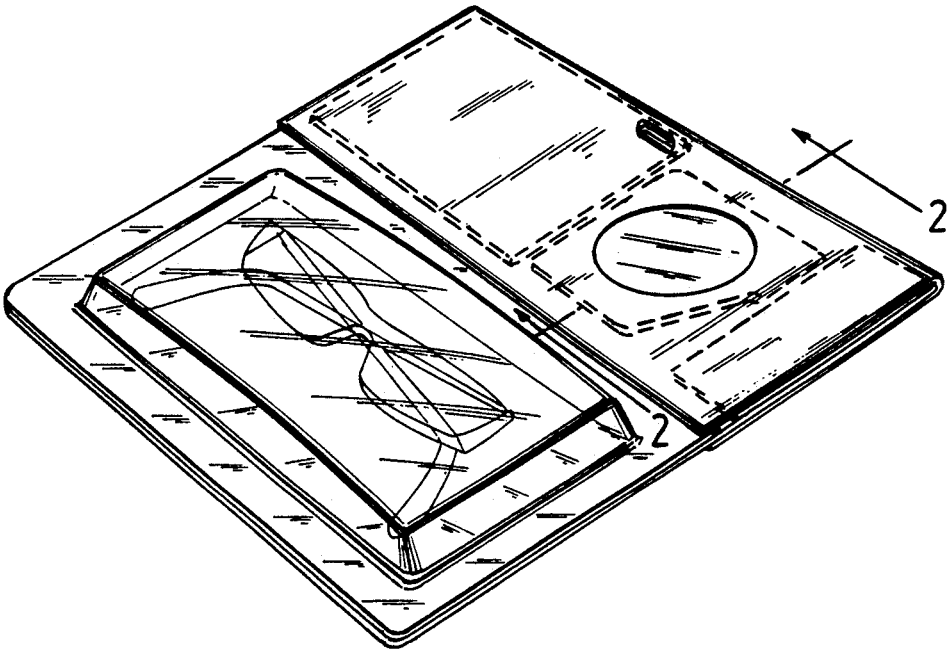
FIG. 1 is a prospective view of the eyewear packaging of the present invention.

Turning now, in detail, to an analysis of the drawing figures, FIG. 1 is a prospective view of a preferred embodiment of the eyewear packaging 10, which preferably includes a tag portion 12 and a portion 14 which encloses the eyewear article 16, which is being offered for sale.

It should be noted that enclosure portion 14 is preferably made of a clear plastic which allows the consumer to view the frame and lens construction, though this is not required and use of an opaque enclosure would still be within the scope of the present invention.

Figure 2:
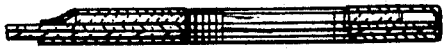
FIG. 2 is a right-hand side, cross-sectional view of the eyewear packaging of the present invention, taken along the 2—2 line of FIG. 1.

Tag portion 12 retains, substantially flush within its plane, lens 18, which has an optic power equal to that of the lenses of eyewear article 16, which is contained within enclosure portion 14. FIG. 2 provides a right-hand, partial cross-sectional view of the packaging of FIG. 1, wherein it may be seen that lens 18 is in a substantially flush relationship with tag portion 12.

By providing lens 18, the prospective consumer is able to test the optical power of the lenses of the glasses 16, without opening enclosure 14. This feature of the present invention is illustrated in FIG. 3.

Finally, FIG. 4 is an elevational view of a preferred embodiment of the eyewear packaging 10 of the present invention, illustrated without a pair of eyewear 16 contained within the enclosure portion 14 of the packaging designed for such purpose.

Other modifications to the present invention are possible, for example, placement of lens 18 may be varied in terms of its placement with the packaging. It is conceivable that lens 18 need not be included flush with tag portion 12. Rather, lens 18 may be contained in any manner with the packaging which allows the consumer to test the optic power of the lenses of the eyewear article without being required to open, and thereby, damage, the eyewear packaging.

The significance of the invention is the use of additional lens 18, which matches the optic power of the eyewear article 16, not its placement in relation to the overall packaging. That illustrated in the accompanying drawing figures is so intended to be solely a preferred embodiment of the invention.

While only several embodiments of the present invention have been shown and described, it will be obvious to those of ordinary skill in the art that many modifications may be made to the present invention without departing from the spirit and scope thereof.

What is claimed is:

1. Packaging for an eyewear article, comprising:

an eyewear article having a pair of lenses with diopter power;

an enclosure portion enclosing said eyewear article for eventual sale;

a tag portion affixed to said enclosure portion; and, an additional lens being in addition to said pair of lenses of said eyewear article, said additional lens being contained within said tag portion with said additional lens being accessible to a prospective consumer for use to test the diopter power of the eyewear article without requiring the prospective consumer to open said enclosure portion for retrieval of said eyewear article contained therein, said additional lens with said tag portion having an optic power which is equal to the diopter power of the pair of lenses of said eyewear article.

2. The packaging for an eyewear article according to claim 1, wherein said additional lens is contained in a substantially flush relationship within said tag portion.

3. The packaging for an eyewear article according to claim 1, wherein said enclosure portion is made, at least in part, of a clear material so that the prospective consumer may view the eyewear article prior to purchase.

4. Packaging for an eyewear article, comprising:

an eyewear article having a pair of lenses with diopter power being enclosed within said packaging; and, one and only one additional lens being in addition to said pair of lenses of said eyewear article, said one and only one lens being contained with said packaging containing said eyewear article and having an optic power which is equal to the diopter power of said pair of lenses of said eyewear article, said one additional lens being accessible to a prospective consumer for use to test the diopter power of the eyewear article without requiring the prospective consumer to open said packaging for retrieval of said eyewear article contained therein.

5. Packaging for an eyewear article, consisting of:

an eyewear article having a pair of lenses with diopter power being enclosed within said packaging; and, one additional lens being in addition to said pair of lenses of said eyewear article, said one additional lens being contained with said packaging containing said eyewear article and having an optic power which is equal to the diopter power of said pair of lenses of said eyewear article, said one additional lens being accessible to a prospective consumer for use to test the diopter power of the eyewear article without requiring the prospective consumer to open said packaging for retrieval of said eyewear article contained therein.

* * * * *